US005716040A

United States Patent [19]

Torres

[11] Patent Number: 5,716,040

[45] **Date of Patent: *Feb. 10, 1998**

[54] SAFETY VEHICLE LIFT

[76] Inventor: Manuel Torres, 44601 17th St., East, Lancaster, Calif. 93535

[ * ] Notice: The term of this patent shall not extend beyond the expiration date of Pat. No. 5,503,368.

[21] Appl. No.: 714,628

[22] Filed: Sep. 16, 1996

[51] Int. Cl.[6] ..... E02C 3/00

[52] U.S. Cl. ..... 254/88

[58] Field of Search ..... 254/88, 122, 126, 254/7 B, 7 R

[56] References Cited

U.S. PATENT DOCUMENTS

| | | | |
|---|---|---|---|
| 3,305,876 | 2/1967 | Hutt | 254/126 |
| 3,870,277 | 3/1975 | West | 254/88 |
| 4,341,371 | 7/1982 | Rotella | 254/88 |
| 4,405,116 | 9/1983 | Eisenberg | 254/122 |
| 5,503,368 | 4/1996 | Torres | 254/88 |

*Primary Examiner*—Robert C. Watson
*Attorney, Agent, or Firm*—Richard L. Huff

[57] ABSTRACT

A safety vehicle lift having a unitary base, a lifting assembly, a drive mechanism, a handle, and a ramp. The base is made of flat rigid construction. The lifting assembly has a lower portion secured to the rear part of the base, a support platform above the lower portion, and cross-linkage elements connecting the lower portion and the support platform in a scissors-like configuration. The support base has side walls, a front end with an upturned edge, and a rear end with an upturned wall. The cross-linkage elements have pivotable ends secured to the rearward parts of the lower portion and the support platform. Each cross-linkage element is made of two bars coupled together. The cross-linkage elements also have ends secured within horizontally disposed recesses within the lower portion and the support platform. A drive mechanism is made up of a jackscrew passing through a threaded cross brace. When the jackscrew is turned, the threaded cross brace moves horizontally. The ends of the cross brace are connected with the horizontally shiftable ends of the cross-linkage elements and move along the horizontally disposed recess of the lower portion, and when the jack screw is turned, there is a resulting raising and lowering of the support platform. The cross brace is coupled to guide rollers which roll along the base upon axial movement of the cross brace and which provide more even lift when only one side of the vehicle is being raised. The lift has a handle for turning the jackscrew. The lift is provided with a ramp having side walls and leading from the level of the unitary base to the level of the support base.

1 Claim, 5 Drawing Sheets

SAFETY VEHICLE LIFT

BACKGROUND OF THE INVENTION

1. Field of the Invention

The present invention relates to a safety vehicle lift which enables smooth lifting of vehicles having a wide range of sizes without the possibility of slipping or rolling.

2. Description of the Related Art

The present invention is an improvement over the invention disclosed and claimed in U.S. Pat. No. 5,503,368. That patent is directed to a safety vehicle lift having a unitary flat base; a lifting assembly comprising a lower portion secured to the base, a support platform above the lower portion, and crosslinkage elements disposed between the lower portion and the support platform; a drive mechanism coupled to the crosslinkage elements containing a jackscrew and a cross brace operably connected to the jackscrew in such a manner that when the jackscrew is rotated the cross brace is forced forwardly or rearwardly to cause the crosslinkage elements to raise or lower the support platform; a handle attached to the jackscrew to rotate the jackscrew; and a ramp leading from the base to the support platform.

The present invention is an improvement over the former invention in that it provides increased smoothness of operation, greater strength and greater protection against the possibility of the vehicle sliding or rolling from the device.

SUMMARY OF THE INVENTION

The present invention is directed to a safety vehicle lift comprising (a) a unitary base of a flat rigid construction; (b) a lifting assembly comprising (i) a lower portion secured to the base, (ii) a support platform above the lower portion, and (iii) crosslinkage elements having axially shiftable lower ends coupling the support platform and the lower portion in a scissors-like configuration; (c) a drive mechanism operatively coupled to the crosslinkage elements comprising a jackscrew with a threaded exterior surface and a cross brace with a threaded interior aperture centrally thereof coupled to the jackscrew and to the axially shiftable lower ends of the crosslinkage elements; (d) a rotatable handle coupled to the jackscrew; and (e) a ramp having a lower end at the front edge of the base and a raised end adjacent to the front edge of the support platform as in the invention described in U.S. Pat. No. 5,503,368 with the improvements as follows.

The support platform of the present invention has a rearward end with an upturned edge, two side edges with upturned walls and a forward end with an upturned wall. This arrangement offers added protection against slipping and rolling compared to the above-mentioned patent.

In the present invention, each of the crosslinkage elements comprises two parallel bars coupled together. The effect of this improvement is to obtain added strength.

The cross brace of the present invention is pivotably attached to guide roller supports which are at the opposing ends of the cross brace. The guide rollers have rearward ends which are attached to the cross brace and forward ends which support a lateral support having opposing ends. At each end of the lateral support there is attached a guide roller which fits into the horizontally disposed recess of the lower portion in order to effect a more even lift.

The side edges of the ramp have upturned walls to add even more security against slipping or rolling off of the device.

DESCRIPTION OF THE PREFERRED EMBODIMENTS

Figure 1:
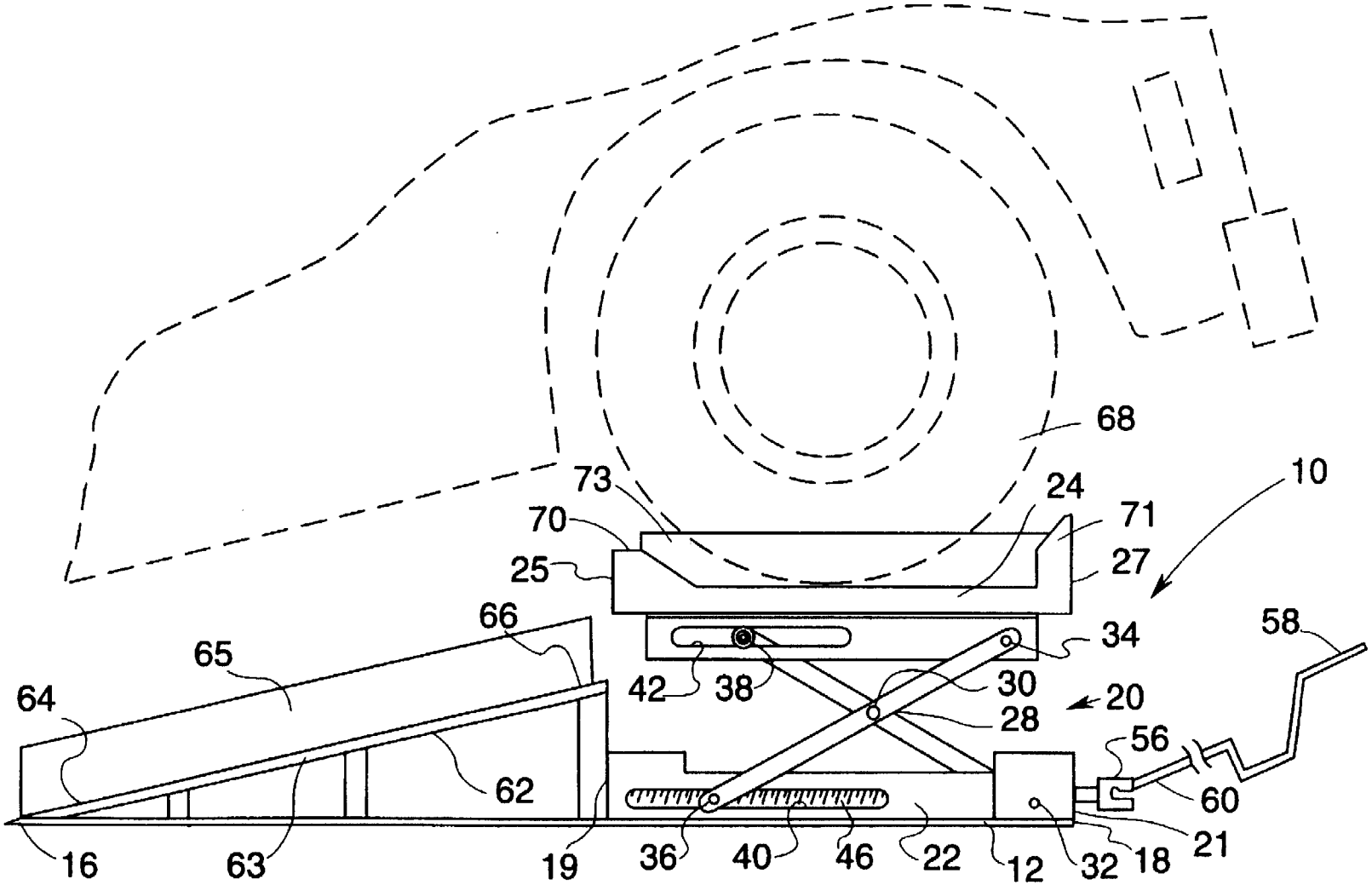
FIG. 1 is a side elevational view of the safety vehicle lift of the present invention with the support platform in a raised position.

The safety vehicle lift of the present invention will now be described with reference to the above drawing. Like elements have like numbers throughout the several Figures.

The safety vehicle lift 10 is a system comprising a base 12, a lifting assembly 20, a drive mechanism, a rotatable handle 56, and a ramp 62.

More specifically, the lift 10 of the present invention contains a unitary base 12 which is of a flat, rigid construction, preferably of sheet metal, for holding together the components which are above it. The base 12 has parallel side edges 14 and parallel front 16 and rear edges 18.

A lifting assembly 20 is secured to base 12.

The lifting assembly 20 comprises a lower portion 22 having front 19, rear 21, and side 23 edges. The lower surface of the lower portion 22 is secured to the base 12 between the side edges 14 and adjacent to the rear edge 18. The lifting assembly 20 extends forwardly to about the midpoint of the base 12.

The lifting assembly 20 also includes a support platform 24 having front 25, rear 27, and side 29 edges and which is positioned above the lower portion 22 and is of a similar length and width as the lower portion 22. The front edge 25 of the support platform 24 has an upturned edge 70. The rear edge 27 of the support platform 24 has an upturned wall 71. The side edges 29 of the support platform 24 have upturned walls 73. These upturned edges and walls prevent supported vehicles from slipping or rolling off of the support platform.

The lifting assembly 20 further contains crosslinkage elements 28 which are secured with respect to the upper surface of the base 12 and the lower surface of the support platform 24. Each crosslinkage element 28 comprises two bars 31 coupled together. The crosslinkage elements 28 couple the support platform 24 and the lower portion 22 for relative movement therebetween as caused during the lifting of the support platform 24. The crosslinkage elements 28 are in a scissors-like configuration physically coupled adjacent to their midpoint. 30 Similar crosslinkage elements 28 are located adjacent to each side edge 14 of the base 12, lower portion 22, and support platform 24. The crosslinkage elements 28 have pivotal ends 32, 34 secured to the lower portion 22 and support platform 24 adjacent to the rearward end 18 above the base 12. The crosslinkage elements 28 also have axially shiftable ends 36, 38 secured in horizontally disposed recesses 40, 42 in the sides of the lower portion 22 and the support platform 24. Such an arrangement allows for the axially shiftable ends 32, 34 to effect parallel movements of the ends 36, 38 of the cross linkage elements 28 within the lower portion 22 and the support platform 24.

Drive mechanism 46 is operatively coupled to the crosslinkage elements 28. The drive mechanism 46 comprises a horizontally oriented, centrally disposed jackscrew 47 between the lower portion 22 and the support platform 24. The jackscrew 47 has a threaded exterior surface 48 coupled with a cross brace 49 having a threaded interior aperture 50 centrally thereof. The cross brace 49 is coupled to the jackscrew 47 through the threads 48 for axial movement of the cross brace 49 upon rotation of the jackscrew.

The cross brace 49 has opposite ends 52, which are secured to the axially shiftable ends 36, 38 of the cross linkage elements 28 within the lower portion 22 to effect their linear movement in a horizontal direction parallel with the lower portion 22 and the support platform 24. This motion is such as to effect the raising and lowering of the support platform while maintaining its parallelism with respect to the lower portion 22. Guide roller supports 74 are attached to each end 52 of the cross brace 49. Each guide roller support 74 has a forward end 75 and a rearward end 76. The forward end 75 of each guide roller support 74 is attached to the cross brace 49. The rearward end 76 of each guide roller support 74 is attached to a lateral support 77 having opposing ends 78, 79. Rotatably mounted to each end 78, 79 of the lateral support 77, is a guide roller 80 As the cross brace 49 is urged forwardly or rearwardly, the guide rollers 80 roll forwardly or rearwardly along base 12 to ensure a more even lift when only one side of a vehicle is being lifted.

Figure 2:
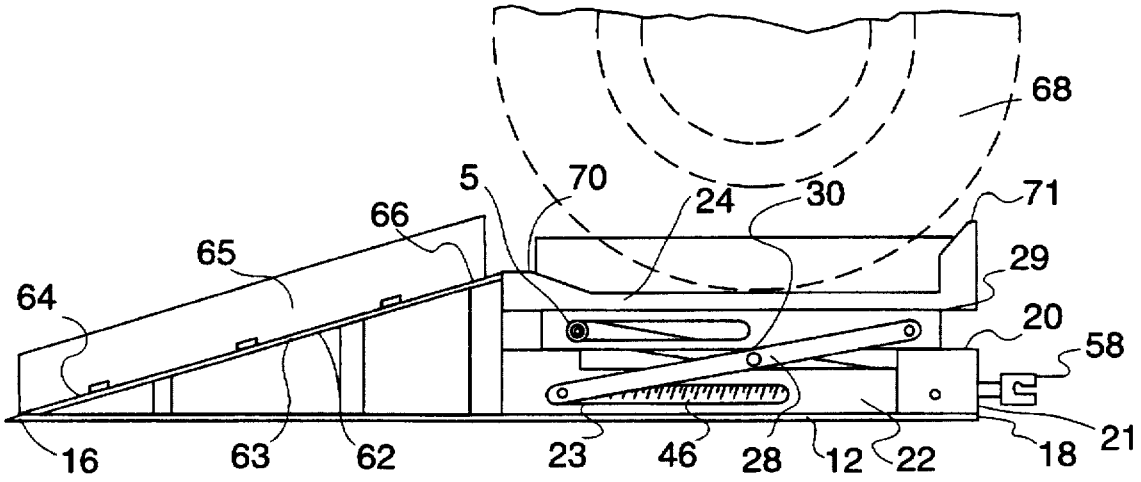
FIG. 2 is a side elevational view of the safety vehicle lift of the present invention with the support platform in a lowered position.
Figure 3:
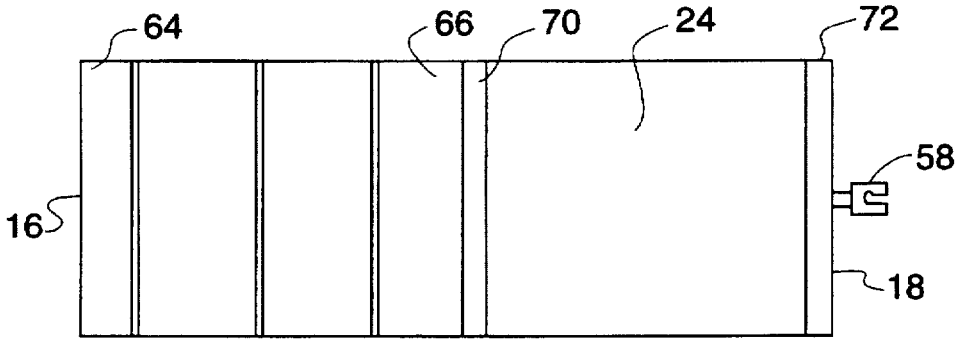
FIG. 3 is a top elevational view of the safety vehicle lift of the present invention.
Figure 4:
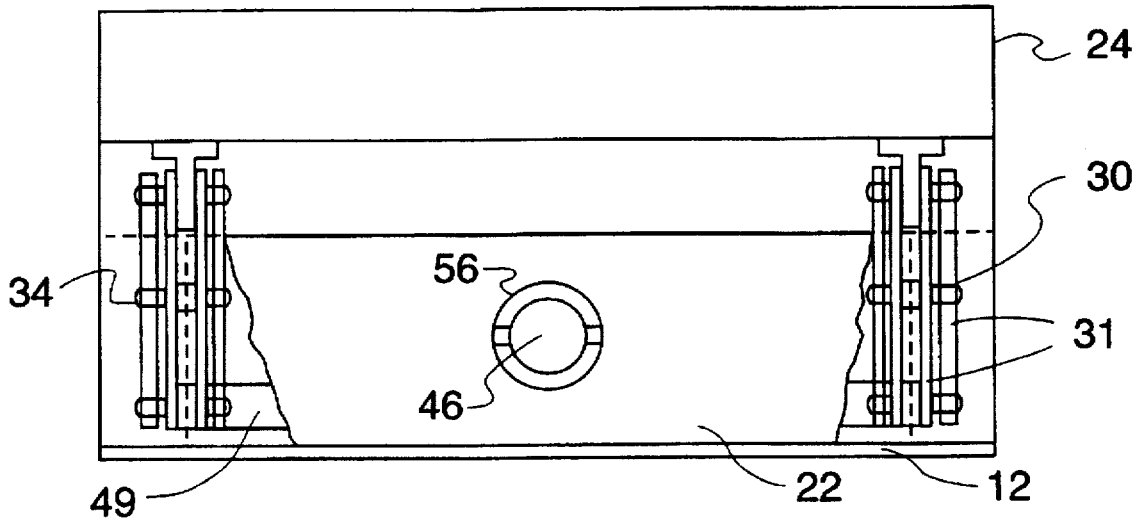
FIG. 4 is a rear elevational view of the safety vehicle lift of the present invention partly in section to show certain construction thereof.
Figure 5:
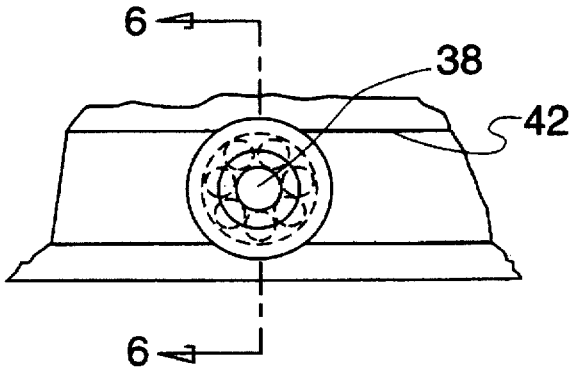
FIG. 5 is a view of the portion of the device taken about circle 5 of FIG. 2.
Figure 6:
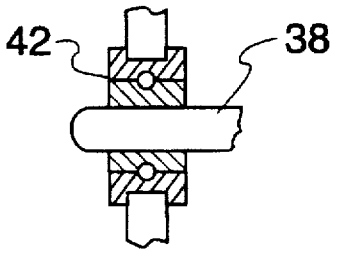
FIG. 6 is a cross-sectional view taken along line 6—6 of FIG. 5.
Figure 7:
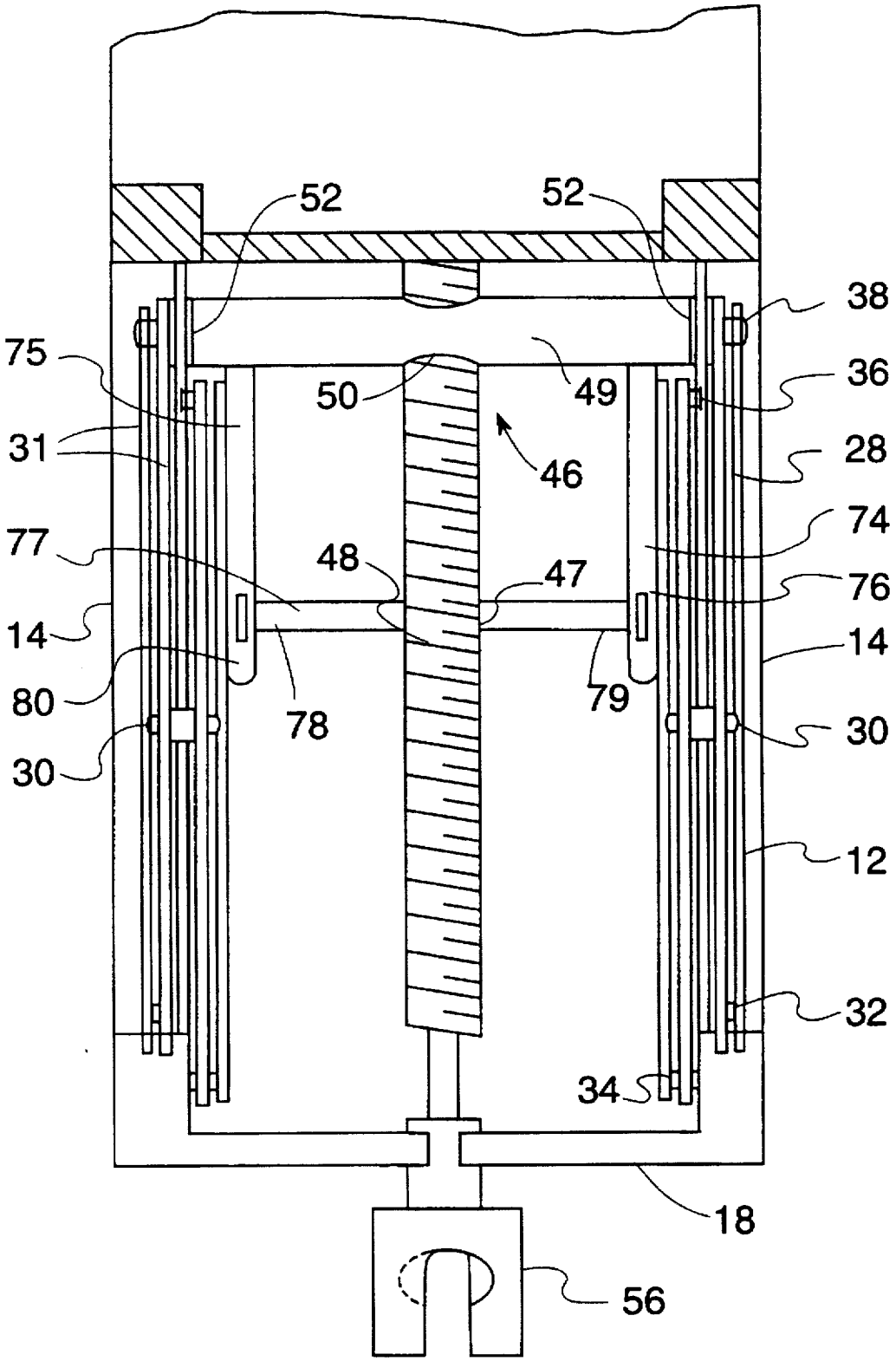
FIG. 7 is a top elevational view of a portion of the safety vehicle lift of the present invention with the support platform removed.
Figure 8:
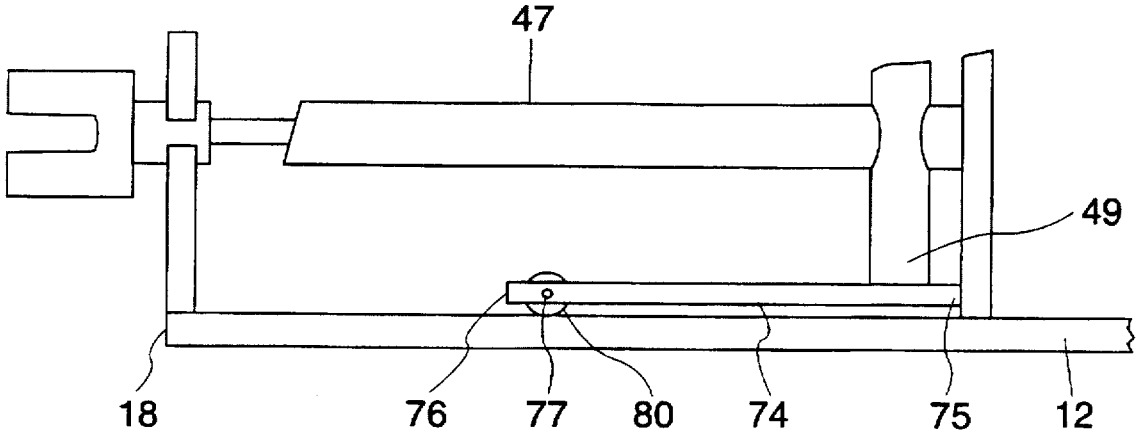
FIG. 8 is a side elevational view showing in detail the relationship between the guide rollers, the guide roller support, and the cross brace.

Rotation of the jackscrew 47 is effected through an operator-controlled handle 56, which handle has an exterior end 58 for being grasped and manipulated by a user. It also has an interior end 60 coupled to the end of the jackscrew 47 over the rear end 18 of the base 12 to effect the desired movement of the support platform 24 between a lower first inoperative orientation as shown in FIG. 2 and a second raised operative orientation as shown in FIG. 1.

The ramp 62 has side edges 63 which have upturned walls 65, a lower end 64 near the front end 16 of the base 12, and a raised end 66 at an intermediate position on the base 12, such intermediate position being about halfway between the front edge 16 and the rear edge 18 of the base 12, the lower end 64 and the raised end 66 being integral with the base 12. The ramp 62 has a shallow incline relative to the base 12 so that the raised end 66 of the ramp 62 is located adjacent to the front edge 25 of the support platform 24. This relationship between the ramp 62 and the support platform 24 is such as to allow the tire 68 of a car to be driven up the ramp 62 and onto the support platform 24 when the support platform 24 is in the lower orientation. The upturned walls 65 protect vehicles being driven up the ramp 62 from slipping or rolling from the ramp 62.

The size of the safety vehicle lift 10 is not critical, and may be manufactured to accommodate vehicles ranging in size from subcompact cars to large trucks by varying the length and width of the support platform 24. Generally, the height of the ramp 62 will be between 7 and 15 inches, the length of the ramp 62 will be between 24 and 48 inches or more, and the length of the support platform 24 will be between 16 and 36 inches. The width of the ramp 62 and the support platform 24 will be such as to conveniently hold a single tire or double tires. For large trucks, the length of the base 12 will be at least 60 inches.

In use, the user positions a vehicle so that a tire is directly in front of the ramp 62, drives the vehicle up the ramp 62, and over the raised edge 70 of the support platform 24 onto the surface of the support platform 24. The raised edge 70 and the upturned walls 71 and 73 will prevent longitudinal or sidewise movement of the vehicle. The portion of the vehicle supported by the lift 10 may then be raised and lowered by manually turning the handle 56. Alternatively, the jackscrew 47 may be rotated by use of electrical, air, or hydraulic power.

The foregoing is considered as illustrative, only of the principles of the invention and the scope of the invention is to be limited only by the scope of the claimed subject matter.

I claim:

1. A safety vehicle lift comprising:

(a) a unitary base of a flat rigid construction having parallel side edges and having parallel front and rear edges;

(b) a lifting assembly comprising (i) a lower portion secured to the base between the side edges of the base and adjacent to the rear edge of the base, (ii) a support platform positioned above the lower portion, (iii) crosslinkage elements coupling the support platform and the lower portion in a scissors-like configuration, the lower portion and the support platform having a similar width and length, the lower portion and the support platform each having front, rear, and side edges, the lower portion and the support platform each having horizontally disposed recesses in the side edges thereof, the support platform having a rearward end with an upturned wall, a forward end with an upturned edge, and two side edges with upturned walls, each crosslinkage element comprising two bars coupled together, the crosslinkage elements having two pivotable ends, one of the pivotable ends being secured to the lower portion and another of the pivotable ends being secured to the support platform, each pivotable end further being adjacent to the rearward end of the base, the crosslinkage elements further having axially shiftable ends moveably secured to a respective horizontally disposed recess for parallel movement within the lower portion and the support platform, the crosslinkage element being secured by the axially shiftable ends;

(c) a drive mechanism operatively coupled to the crosslinkage elements, the drive mechanism including (i) a jackscrew with a threaded exterior surface (ii) a cross brace with a threaded interior aperture centrally thereof coupled to the jackscrew, the cross brace having opposite ends secured to the axially shiftable ends of the crosslinkage elements within the lower portion for linear movement thereof parallel with the lower portion to effect the raising and lowering of the support platform to raised and lowered positions while maintaining its parallelism with the lower portion the opposite ends of the cross brace being coupled to guide rollers which roll along the base upon axial movement of the cross brace;

(d) a rotatable handle having an interior end and an exterior end and being coupled at its interior end to the jackscrew to effect the desired movement of the support platform; and (e) a ramp having side edges, a lower end near the front edge of the base and a raised end at an intermediate portion of the base between the front edge and the rear edge of the base and being adjacent to the front edge of the support platform, the lower end and the raised end of the ramp being integral with the base, the ramp having a shallow incline relative to the base, the raised end of the ramp being of the same height as the support platform when the support platform is in its lowered position, and the side edges of the ramp having upturned walls.

* * * * *